US009704325B2

(12) United States Patent
Onipchenko et al.

(10) Patent No.: US 9,704,325 B2
(45) Date of Patent: Jul. 11, 2017

(54) CASHBOX WITH LATCH ARRANGEMENT

(71) Applicant: CRANE CANADA CO., Concord (CA)

(72) Inventors: Oleksandr Onipchenko, Thornhill (CA); Pavel Rabinovich, Richmond Hill (CA)

(73) Assignee: CRANE CANADA CO., Concord, ON (CA)

( * ) Notice: Subject to any disclaimer, the term of this patent is extended or adjusted under 35 U.S.C. 154(b) by 0 days.

(21) Appl. No.: 14/777,377

(22) PCT Filed: Mar. 14, 2014

(86) PCT No.: PCT/CA2014/000259
§ 371 (c)(1),
(2) Date: Sep. 15, 2015

(87) PCT Pub. No.: WO2014/138928
PCT Pub. Date: Sep. 18, 2014

(65) Prior Publication Data

US 2016/0035170 A1 Feb. 4, 2016

Related U.S. Application Data

(60) Provisional application No. 61/791,085, filed on Mar. 15, 2013.

(51) Int. Cl.
*G07D 11/00* (2006.01)
*G07F 7/04* (2006.01)
(Continued)

(52) U.S. Cl.
CPC ..... *G07D 11/0021* (2013.01); *B65H 29/40* (2013.01); *B65H 29/46* (2013.01);
(Continued)

(58) Field of Classification Search
CPC ..... G07F 1/042; G07F 1/043; G07F 1/044; G07F 7/04; B65H 2701/1912;
(Continued)

(56) References Cited

U.S. PATENT DOCUMENTS 4,434,931 A 3/1984 Hunt et al.
5,254,841 A * 10/1993 Watabe ..... G07F 7/04 235/379
(Continued)

FOREIGN PATENT DOCUMENTS

CA 2171135 A1 9/1997
JP 08044927 A * 2/1996

OTHER PUBLICATIONS

International Search Report dated Jun. 3, 2014 in connection with International Patent Application No. PCT/CA2014/000259; 3 pages.
(Continued)

*Primary Examiner* — Luis A Gonzalez

(57) ABSTRACT

A cashbox is provided with a movable latch that is driven by a banknote to a blocking position if an attempt to 'phish' a stacked banknote from the cashbox occurs. The latch arrangement is easily pivoted in one direction from a neutral position to a clear position during stacking of a banknote. If an attempt is made to 'phish' a stacked banknote, the banknote being "phished" causes rotation of the latch arrangement from the neutral position to a banknote inlet blocking position retaining the banknote in the cashbox.

19 Claims, 11 Drawing Sheets

(51) Int. Cl.

| | |
|---|---|
| ***G07F 1/04*** | (2006.01) |
| ***B65H 29/40*** | (2006.01) |
| ***B65H 29/46*** | (2006.01) |
| ***B65H 31/18*** | (2006.01) |

(52) U.S. Cl.
CPC ..... *B65H 31/18* (2013.01); *G07D 11/0018* (2013.01); *G07F 1/042* (2013.01); *G07F 1/043* (2013.01); *G07F 7/04* (2013.01); *B65H 2701/1912* (2013.01)

(58) Field of Classification Search
CPC .... B65H 31/26; B65H 31/18; G07D 11/0018; G07D 11/0021; G07D 11/0012; G07D 11/0003; G07D 11/0009
See application file for complete search history.

(56) References Cited

U.S. PATENT DOCUMENTS

| | | | | |
|---|---|---|---|---|
| 5,533,605 | A | 7/1996 | Mays et al. | |
| 5,564,691 | A * | 10/1996 | Hatamachi | B65H 29/46 271/178 |
| 6,105,747 | A * | 8/2000 | Uemizo | G07D 11/0003 194/203 |
| 6,668,998 | B1 * | 12/2003 | Mosteller | G07F 7/04 194/203 |
| 2002/0070496 | A1 * | 6/2002 | Ito | B65H 29/16 271/177 |

OTHER PUBLICATIONS

European Search Report dated Nov. 22, 2016 in connection with European Application No. 14764112.0, 4 pages.

* cited by examiner

CASHBOX WITH LATCH ARRANGEMENT

CROSS-REFERENCE TO RELATED APPLICATION(S)

The present application claims priority under 35 U.S.C. §365 to International Patent Application No. PCT/CA2014/000259 filed Mar. 14, 2014, entitled "CASHBOX WITH LATCH ARRANGEMENT". International Patent Application No. PCT/CA2014/000259 claims priority under 35 U.S.C. §365 and/or 35 U.S.C. §119(a) to U.S. Patent Application No. 61/791,085 filed Mar. 15, 2013, which is incorporated herein by reference into the present disclosure as if fully set forth herein.

FIELD OF THE INVENTION

The present invention relates to cashboxes of the type used in banknote validators and in particular relates to a cashbox having a latch arrangement that moves to a blocking position during an unauthorized attempt to extract a received banknote from the cashbox.

BACKGROUND OF THE INVENTION

Banknote validators and cashboxes are subject to various attacks to fraudulently remove banknotes from the cashbox or the banknote validator during or after receipt of a banknote.

A common approach is referred to as "phishing" where a length of string or tape is attached to the trailing edge of a banknote and extends out of the banknote validator. Once the banknote has been accepted and the customer has received the appropriate credit, the string or tape is used in an attempt to withdraw the received banknote from the equipment. Various arrangements have been provided in the banknote processing channel of the banknote validator for detecting of such substrates attached to the tail of a banknote as well as the provision within the banknote channel of a latch or various catch surfaces for preventing the unauthorized rearward withdrawal of an accepted banknote. If the string or substrate is detected the banknote can be rejected and returned to the customer.

The provisions of latches or catch surfaces in the banknote processing channel and/or detection of an attachment to the tail of a banknote reduces the likelihood that the "phishing" attempt will be successful, however the banknote that has been partially displaced rearwardly may jam the banknote validator or cashbox. Reprocessing of the banknote to return it to the cashbox in a normally received state may be difficult and can be particularly problematic if the banknote is damaged or jammed in the equipment. The banknote validator has effectively defeated the phishing attempt, however the device may no longer be operative, requires service and business is lost.

The present invention provides an effective latch arrangement for a cashbox that provides a cost effective early counter response to a phishing attempt.

BRIEF DESCRIPTION OF THE DRAWINGS

Preferred embodiments of the invention as shown in the drawings wherein:

FIGS. 11 and 12 show details of the pusher plate of the staking arrangement and the latch arrangement.

DETAILED DESCRIPTION OF THE PREFERRED EMBODIMENTS

The cashbox 2 is typically a locked box that receives and stores banknotes within the cashbox until it properly opened. Banknotes, accepted by a banknote validator, are provided to the inlet 4 of the cashbox and are stacked within the cashbox using a stacker mechanism 5. The cashbox can be made of metal or plastic or a combination of materials as is well known.

Figure 1:
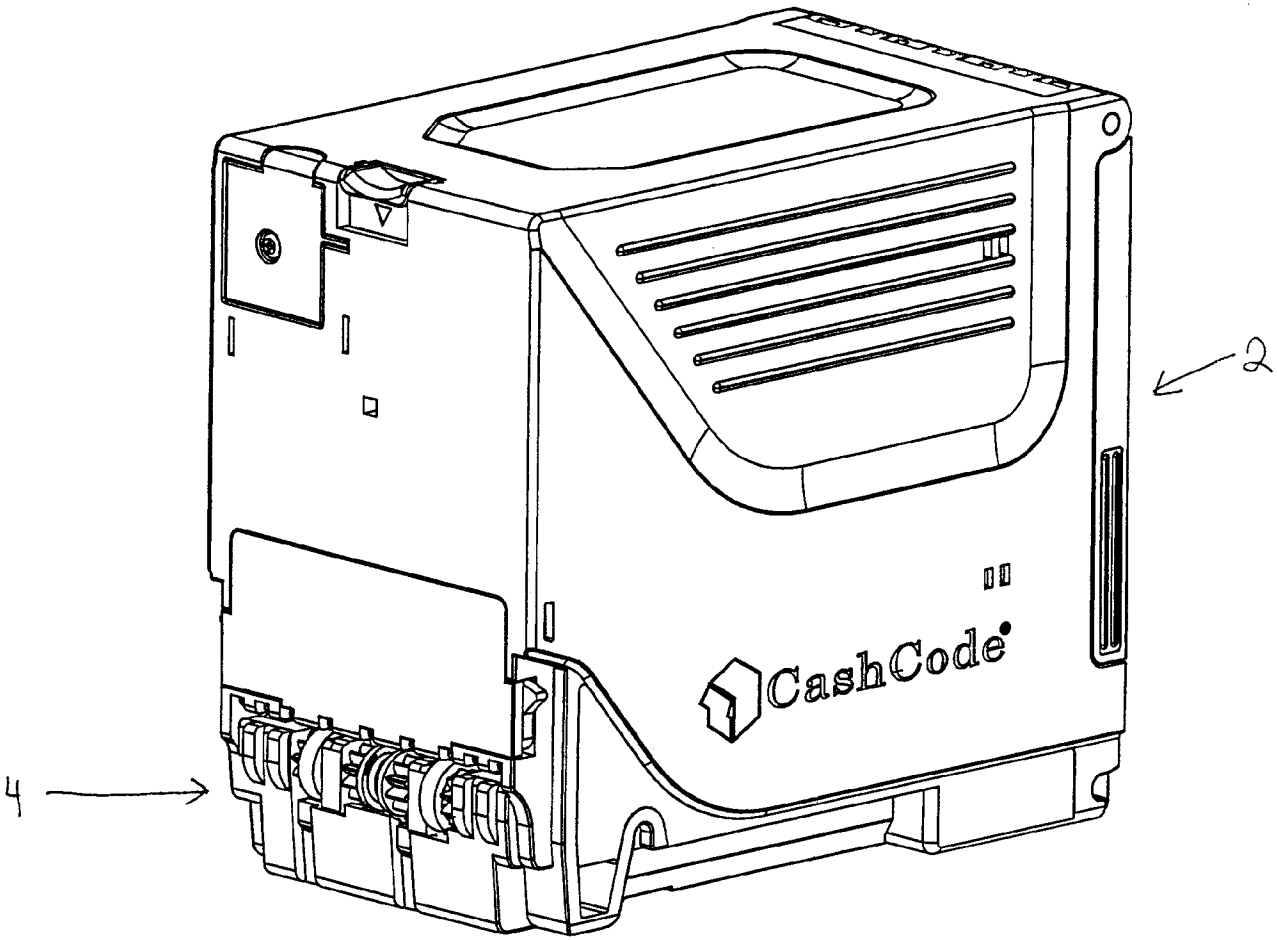
FIG. 1 is a perspective view of a cashbox and the structure thereof adjacent the banknote inlet.
Figure 2:
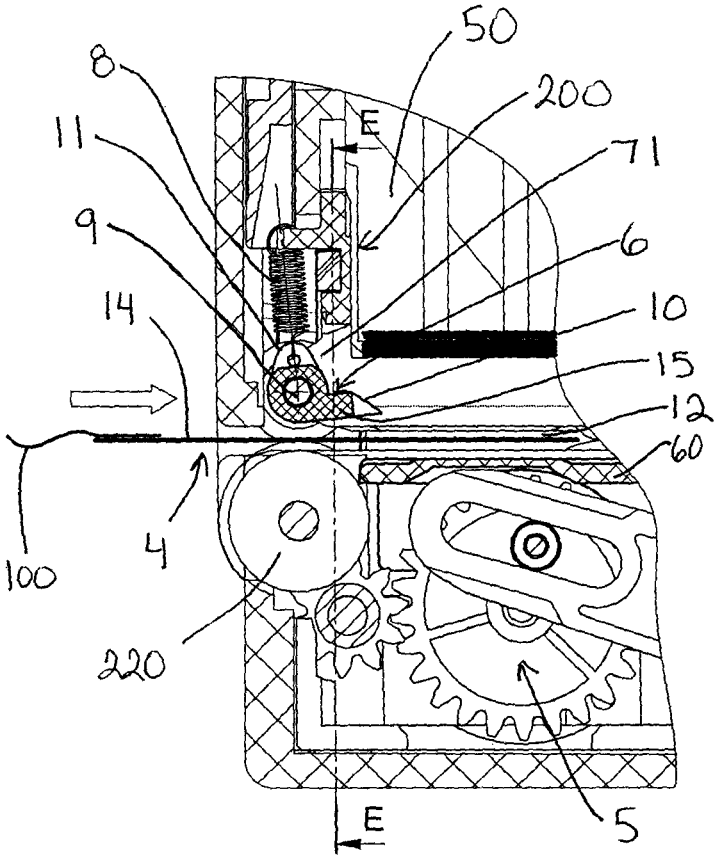
FIGS. 2 through 4 are partial cross-sections of the cashbox showing the receipt of a banknote to the cashbox and the latch arrangement responsive to unauthorized withdrawal of a banknote from the cashbox.
Figure 4:
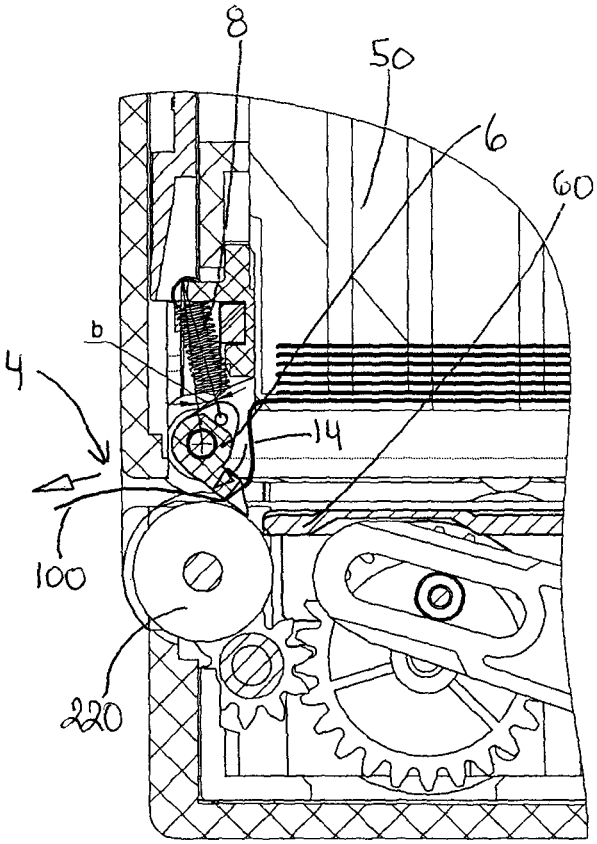

A lightly biased latch arrangement 6 is associated with the banknote inlet 4. The latch arrangement in its normal neutral position is shown in FIG. 2 and is located to one side of the banknote receiving channel 12 allowing banknotes such as banknote 14 to freely pass through the banknote inlet 4 and overlap with a pusher plate 60. Once the banknote 14 has been fully received into the cashbox 2, the stacker mechanism 5 is operated (typically by a motor of the bill validator) and the pusher plate 60 forces the received banknote into the storage chamber 50. The stacker mechanism is then retracted as shown in FIG. 4 ready to receive a further banknote.

The latch arrangement 6 rotates about the pivot axis 9 and includes a series of spaced teeth extending across the cashbox in the length of the latch arrangement. A light spring 8 is connected to arm 11 of the latch arrangement. FIG. 2 shows the neutral position of the latch arrangement. Spring 8 exerts sufficient force to maintain the latch arrangement in this position when no other forces are present.

When a banknote enters the cashbox 2, the latch arrangement 6 is in the neutral position of FIG. 2 and does not essentially alter the receipt of the banknote 14. Once the banknote has been fully received, the pusher plate 60 forces the received banknote into the storage chamber 50.

Figure 3:
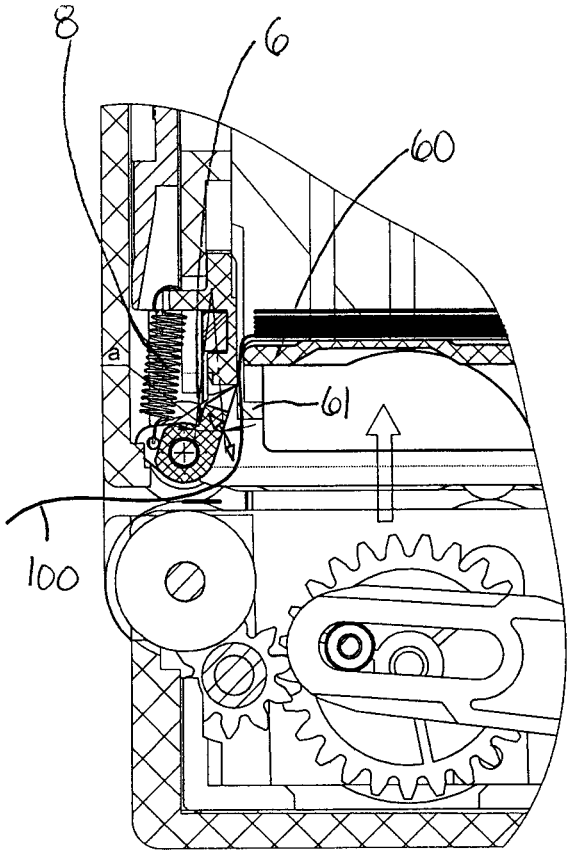

The pusher plate 60, during the stacking of a banknote, pivots the latch to the position of FIG. 3. The stacker plate is then returned to the initial position as shown in FIG. 4. It would be at this time that a person attempts to withdraw the received and accepted banknote 14 using the string or tape attachment 100. If the attachment 100 is tape for example, pulling on this tape will cause the tape to engage the teeth 10 and force the teeth against the drive roller or driver rollers 220 and block the banknote inlet. The latch arrangement 6 can be designed to encourage breakage of the attachment 100, however initially the attachment 100 will be displaced by the latch arrangement and engages the drive roller 220. In some cases, the received and stacked banknote 14 will be partially pulled from the storage chamber, and engage the latch arrangement 6 causing it to move and engage the drive roller 220. The spring bias of the latch arrangement is a light spring bias as the latch is designed to be generally passive to the normal operation of the cashbox and only enters the position of FIG. 4 if a phishing attempt is made.

A particular advantage of the latch arrangement 6 is that the latch arrangement is positioned outside of the normal banknote channel of the banknote validator and is provided on an inside wall of the cashbox adjacent the inlet. The latch arrangement is positioned to one side of the inlet and out of normal contact with the banknote receiving channel. The latch arrangement is located between the banknote channel 12 and the banknote storage chamber 50. By positioning the latch arrangement between these structures, the latch arrangement does not directly contact the banknote during normal processing. It only contacts the banknote in the event the banknote is attempted to be withdrawn after it has been received and stored within a storage chamber of the cashbox.

When the cashbox is removed from a banknote validator it may also be subject to an unauthorized or fraudulent attempt to withdraw banknotes. Although the banknote slot 4 is designed to make access to the cashbox difficult, it is an opening to the cashbox and specialized tools have been used to engage and remove a last received banknote. The latch arrangement 6 of the present cashbox continues to provide a deterrent with respect to a phishing attempt. The latch arrangement includes a series of spaced teeth disposed across the width of the cashbox providing gaps allowing thin string or threads to essentially pass between the storage chamber 50 and the banknote inlet. The latch arrangement 6 is projecting across the gap between the storage chamber 50 and the banknote inlet and is free to move to the locking position of FIG. 4 when driven by a banknote attempted to being withdrawn.

A string or attachment such as 14 shown in FIGS. 2 to 4 may pass between one of the teeth, however the end of the banknote will engage the latch arrangement 6 and cause it to move to the blocking position of FIG. 4 slightly increasing the tension in spring 8. The bias force on the latch arrangement is very light and will move to the blocking position quite easily when the end of a banknote attempting to be removed strikes the latch arrangement. The force exerted by the user on the banknote causes the latch to pivot extending spring member 8. The engagement of the banknote 14 with the latch arrangement 6 as shown in FIG. 4 prevents any further withdrawal of the banknote. Typically the string 100 will separate from the banknote 14 or the string, thread or tape may break.

It is preferred once, the string 100 has detached from a banknote that the latch arrangement 6 will return to the clear position as shown in FIG. 2. Basically; there is some clearance at the end of the banknote cassette which will accommodate the extent that the banknote 14 was displaced to that end of the cashbox. In this way, the cashbox 2 can continue to function and the latch arrangement will also ensure that the partially withdrawn banknote 14 does not jam the banknote receiving channel 12. As more banknotes are received, the displaced end portion of the banknote subject to the phish attempt is deeper into the storage chamber and does not create a problem.

This self-returning latch arrangement 6 that does not directly contact a banknote during normal processing thereof and has proven particularly effective as a cost effective deterrent structure having good reliability and durability.

The pusher plate 60 when used to store a banknote in the storage chamber 50 engages the latch arrangement 6 causing it to pivot in a counterclockwise direction. The arm 15 with the teeth 10 are moved into a recess 71 of the wall allowing the pushing plate 60 to easily move the latch arrangement out of the way. As can be seen, a side wall 61 of the pusher plate maintains the latch arrangement in the recess 71 of the wall.

Figure 6:
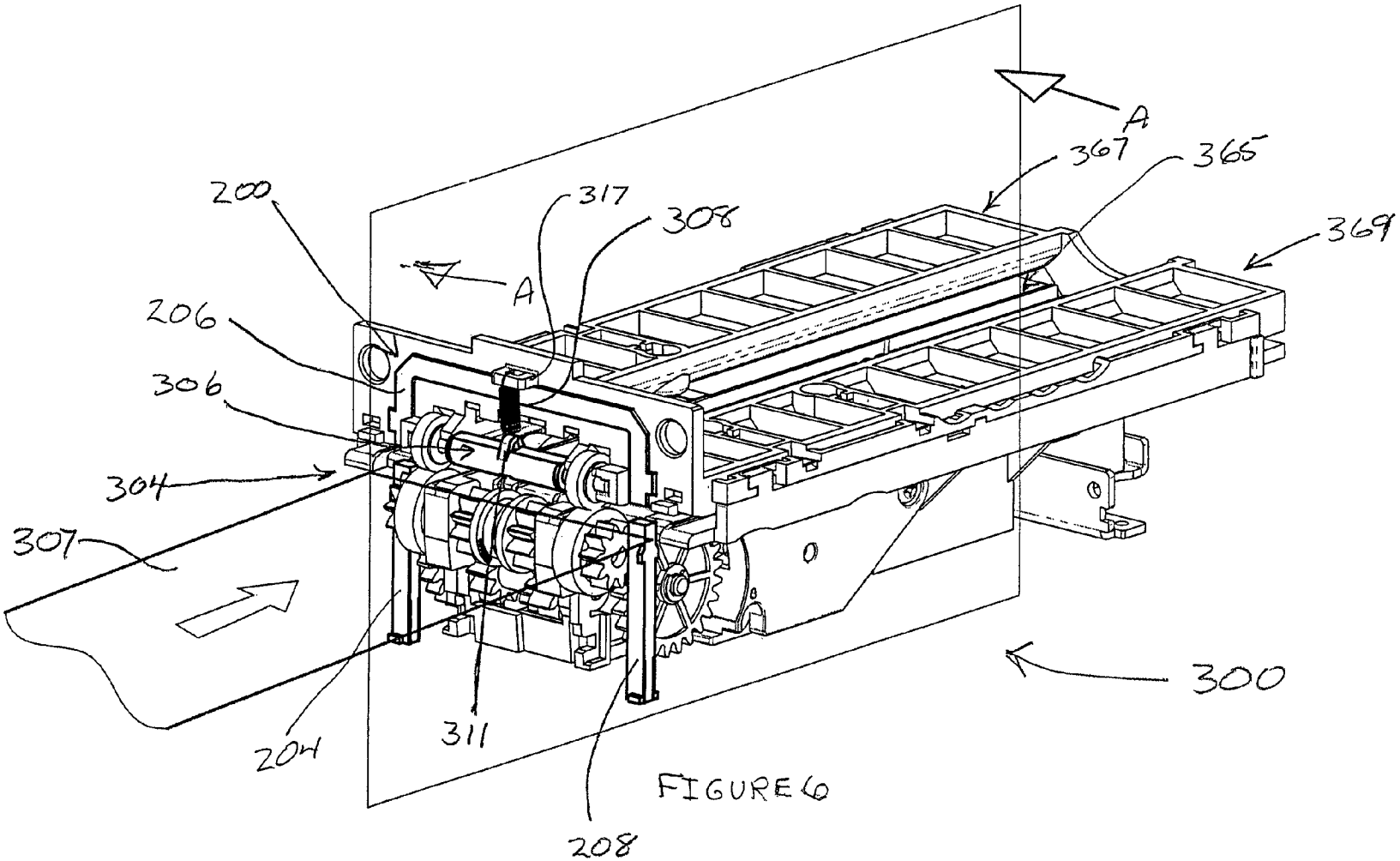
FIG. 6 is a perspective view of the stacker and latch arrangement inserted as an assembly into a cashbox.

As can be appreciated from a review of the latch arrangement 6, the spring bias 8 causes the latch arrangement 6 to normally assume the neutral position of FIG. 6. Movement of the pusher plate 60 to stack a banknote, causes a counterclockwise rotation of the latch arrangement and a tensioning of the spring 8. Return of the pusher plate to the position of FIG. 2 causes the spring bias to return the latch arrangement to the neutral position. An attempt to withdraw the last received banknote by means of a phishing attempt pulling on an attachment 100 causes a clockwise rotation of the latch arrangement 6 as the arm 15 is extending across the exit path of the banknote. The end of the banknote strikes the arm 15 and causes it to pivot the latch arrangement to the blocked position of FIG. 4.

Figure 5:
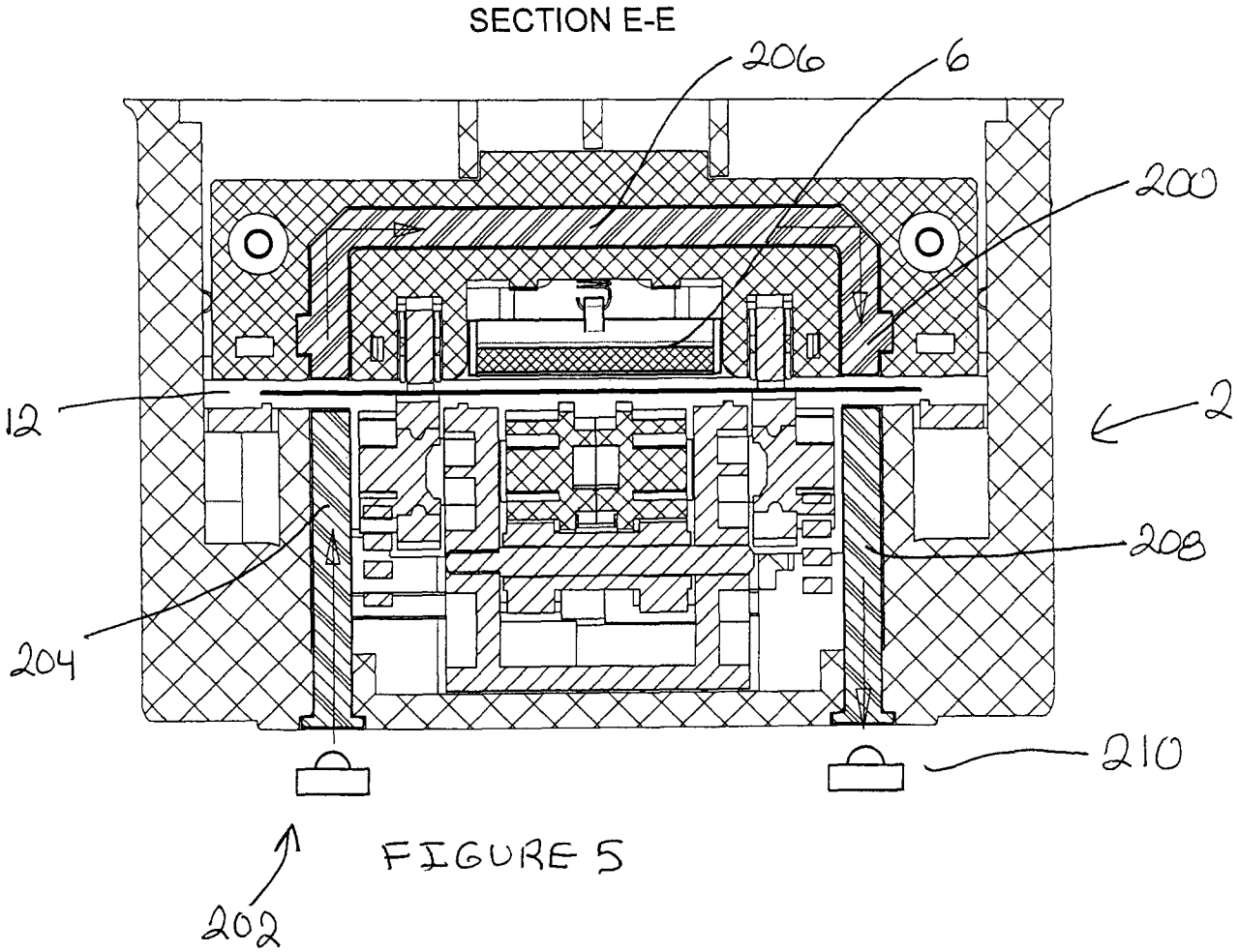
FIG. 5 is a cross-sectional view of the cashbox providing details of a sensing arrangement associated with the banknote inlet of the cashbox.

A further embodiment of the invention is shown in FIG. 5 where a sensing arrangement 200 is positioned adjacent the latch arrangement 6 for detecting whether a banknote is fully received within the cashbox. Once the banknote is fully received in the cashbox, it is then possible to cycle the banknote to the stacking mechanism to displace the received banknote into the storage chamber 50. The sensing arrangement includes a light transmitter 202 (typically art of the bill validator), a light passage 204 which transmits the light to the banknote channel 12 and a further light transmission path 206 passing the light to the opposite side of the cashbox. The light then passes to the light passage 208 and reaches the light receiver 210 (typically a component of the bill validator). FIG. 5 is a sectional view of the cashbox taken along lines E-E of FIG. 2.

This banknote sensing arrangement is used to produce a clear signal that the banknote has cleared through the banknote slot and overlies the pusher plate ready for cycling into the storage chamber. Basically, a banknote that is only partially received in the cashbox will interrupt the transmitted light and it is the act of moving the banknote to be fully received over the pusher plate that clears the banknote inlet allowing sensing arrangement 200 to produce a clear signal indicating that cycling can occur.

This sensing arrangement provides a confirmation signal that the banknote has been appropriately received. If the banknote has not been fully received, i.e. a clear signal has not been produced, than the banknote validator can effectively cause a cycling of the banknote to attempt to move the banknote to a fully received position.

In the embodiment of FIG. 5 the light transmitter 202 and the light receiver 210 are associated with the banknote validator and are aligned with the passages 204 and 208 when the cashbox has been properly received in the validator. If a banknote has been properly received in the banknote channel 12, the end of the banknote will be clear of the banknote slot allowing light to pass through the passage 204, 206 and 208. The receipt of the light confirmed by the receiver 210. In this way, the banknote validator receives a confirmation signal that the banknote has been fully received and that an end portion of the banknote is not projecting out of the cashbox. By providing both the light transmitter and the light receiver as part of a banknote validator, the cashbox remains a passive-type structure. The light transmitting conduits within the cashbox 2 provide a simple cost effective arrangement that provides additional information regarding whether the cashbox can be properly cycled for placing a received banknote into the storage chamber 50.

A banknote that is not fully received in the banknote channel 12 could cause jamming of the cashbox for example if a large portion of the banknote was not fully received. A partially received banknote still in engagement with rollers of the banknote validator often produces jamming, buckling and/or wrinkling of the banknote adjacent the inlet 4. These potential problems are avoided by receiving a confirmation signal that the banknote has been properly received. If a banknote is not confirmed as properly received banknote, the banknote validator can return the banknote to the user or continue to process the banknote in a series of reversing steps until the banknote is fully received by the cashbox.

It has been found that the cashbox with the latch arrangement and sensing arrangement provide additional security and reliability of the cashbox.

The provision of the sensing arrangement for determining whether a banknote has been fully received provides additional information to the banknote validator for determining a) the condition of the banknote and thus information with respect to a possible jam condition that can be used to initiate steps to clear the problem condition; and b) furthermore this information may be helpful in determining that a problem requiring authorized personnel may have occurred.

The sensor arrangement also provides information with respect to the position of the last received banknote.

A desirable feature of the latch arrangement is the use of the spring bias to maintain the latch in a neutral position during initial receipt of a banknote. During receipt of a banknote into the cashbox, the latch arrangement is out of contact with the banknote. The latch arrangement is moved by the pusher plate during the movement to store the banknote in the storage chamber 50. The latch arrangement returns to a neutral position when the pusher plate is returned to its initial position. The latch arrangement in its neutral position extends across the path that a banknote takes if a phishing attempt is made. Thus the latch is automatically in the position to stop unauthorized withdrawal of a banknote and moves to a blocking position during this unauthorized withdrawal attempt. If the last banknote is attempted to be withdrawn by a phishing type act, the latch arrangement swings from the neutral position and blocks the banknote inlet.

With this arrangement, the latch arrangement remains out of contact with banknotes during the receipt thereof and only comes into contact with the banknotes in the event that a banknote is attempted to be withdrawn. This avoids problems associated with jamming of banknotes that can occur with anti-phishing structures which contact the banknote during the receipt thereof or displacement into the storage chamber.

As can be appreciated, it is known for banknote validators to cause a received banknote to move back and forth prior to full receipt in a cashbox. Such back and forth movement may be necessary to clear a jam or to better position the banknote for receipt in a cashbox.

Any latch arrangement which engages a banknote during the receipt thereof will interact with the banknote during this forward and reverse movement of the banknote and adds unnecessary additional potential issues.

Figure 7:
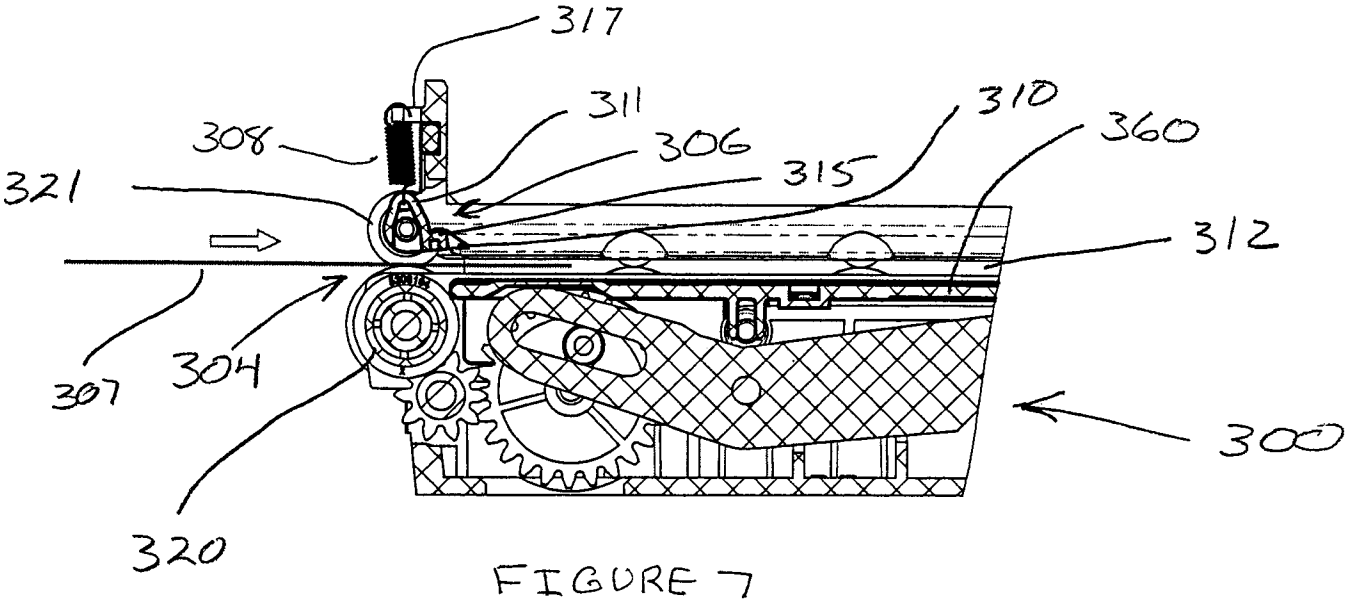
FIGS. 7 through 10 are sectional views taken along plane A-A with the pusher plate of the stacker in different positions during a stacking sequence.

Additional details of the banknote latch are shown in FIGS. 6 through 10. There are some differences with respect to the structure of the earlier drawings and therefore a new numbering sequence has been used. The stacker 300 and the latch arrangement 306 are shown separately and are designed for insertion in a cashbox. The banknote inlet is generally shown as 304 that is about to receive a banknote 307. The light sensing arrangement 200 is also illustrated. The latch arrangement 306 includes the spring bias 308 having one end attached to the attachment bracket 317 and an opposite end attached to the bias arm 311. The latch arrangement includes projecting arm 315 that in a neutral position of the latch arrangement as shown in FIG. 7 extends parallel to the receiving channel 312.

As was described with respect to the earlier figures, the latch arrangement 306 in a neutral position thereof as shown in FIG. 7 allows the banknote 307 that is being received in the receiving channel 312 to freely pass into this channel. The banknote 307 is driven into the channel by drive roller 320 having a passive roller 321.

There may also be active rollers within the banknote receiving channel 312 as shown in the sectional views. In FIG. 7 it can be seen that the spring bias latch 306 does not effect the normal receipt of a banknote in the banknote receiving channel 312.

Figure 8:
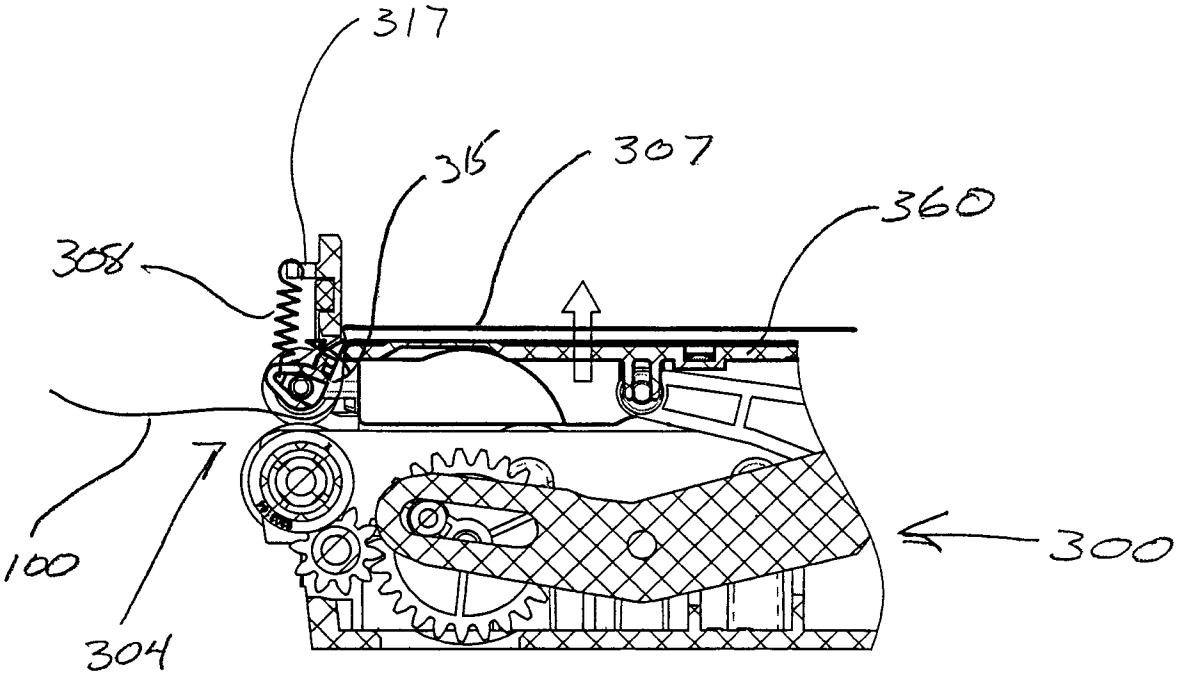

In the sectional view of FIG. 8 it can be seen that the stacker mechanism 300 has caused the pusher plate 306 to move across the banknote processing channel and through the open gap 365 (see FIG. 6) to allow the banknote to be received within the storage chamber. Either side of this gap are stationary banknote retaining plates 367 and 369. Basically a banknote is forced through the gap 365 to a position allowing the banknote to again assume a planar type configuration whereupon the withdrawal of the stacker plate back through the gap allows the banknote to be retained on the retainer plates 367 and 369.

Figure 11:
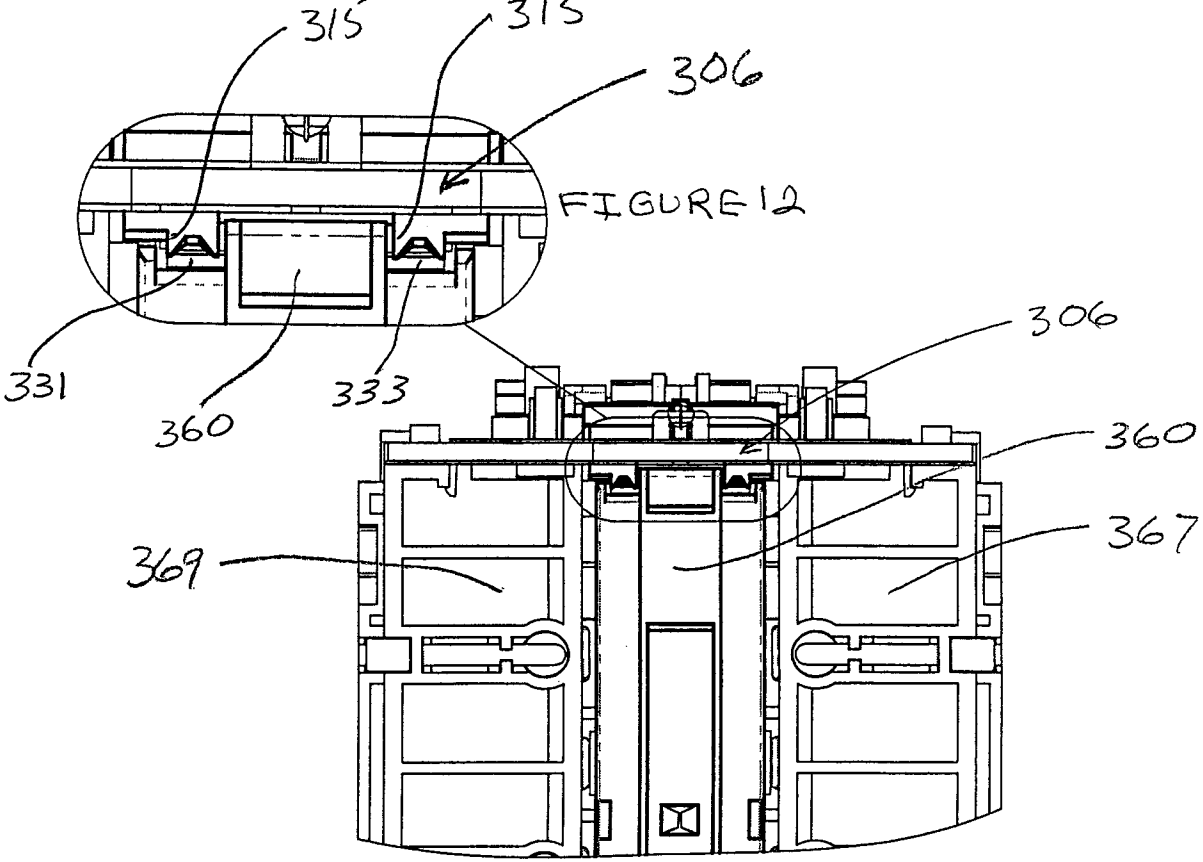

It is preferred that the pusher plate 360 include gaps sized to allow one or more projecting arms 315 of the latch arrangement 306 to pass through the gap. This arrangement is shown in FIGS. 11 and 12. FIGS. 11 and 12 show two projecting arms 315 with one arm aligned for passage through recess 331 and the other arm 315 aligned for passage through recess 333. Recesses 331 and 333 in the pusher plate allows the pusher plate to remain out of contact with the latch arrangement. A received banknote on the pusher plate may contact and pivot the latch out of the way. A stacked banknote during a phishing attempt strikes the arms 315 and pivots the latch arrangement to a blocking position closing the banknote slot.

Each of the arms 315 are shaped as a projecting 2 prong fork with the gap between the prongs engaging a drive roller located at the banknote slot. The pusher plate 360 extends almost to the pivoting body of the latch arrangement defining an exit path for a banknote that assists in retaining the banknote.

With this arrangement it is the action of the banknote 307 supported on the pusher plate 360 that causes the latch to be moved to the position shown in FIG. 8. Basically the projecting arm 315 due to engagement with the banknote being forced therepast by the pusher plate causes the arm to rotate the latch arrangement and extend the spring bias 308.

Figure 9:
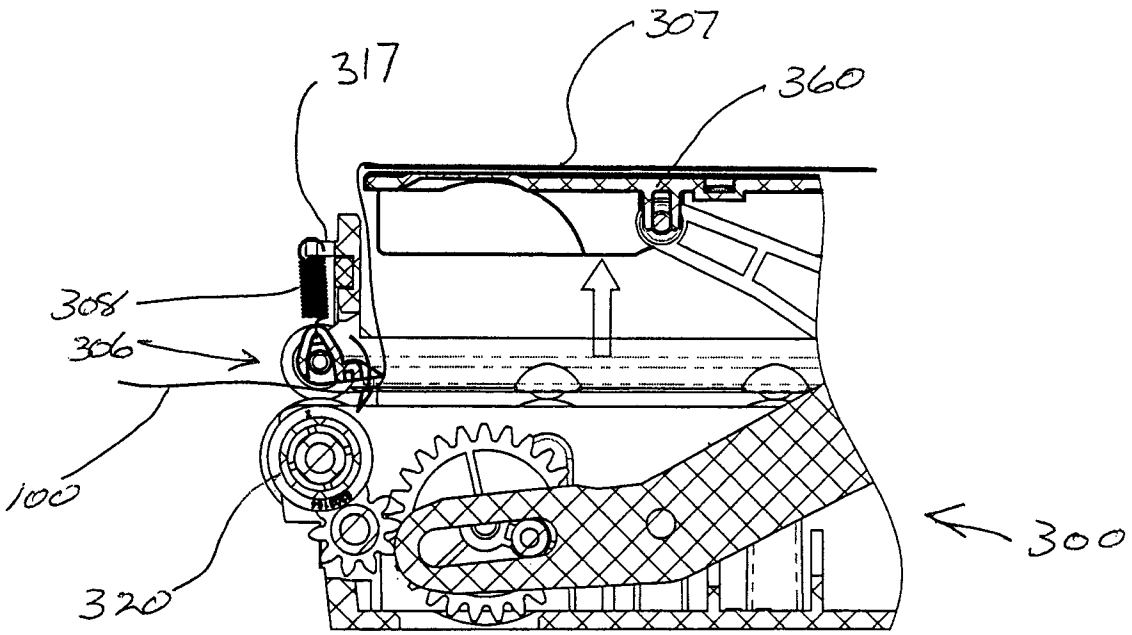

As shown in FIG. 9, the stacker 300 has caused the pusher plate 360 to move into the banknote storage chamber and the arm 315 of the latch has again returned to the neutral position as the spring 308 provides sufficient force to assume the neutral position.

Figure 10:
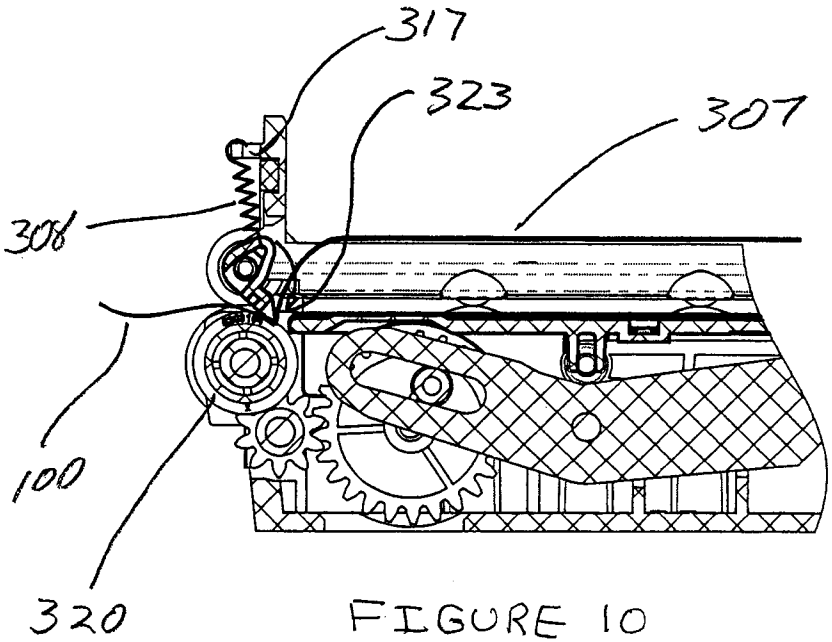

FIGS. 7 through 10 have shown the banknote 307 with a string type attachment 100 that may be present to attempt to phish the banknote 307 from the banknote cashbox. In FIG. 10 a user attempting to phish the last banknote 307 from the cashbox and through an associated banknote validator has pulled on the string 100. Initially the banknote 307 has had one end thereof pass through the gap 365 and the end 323 of the banknote has engaged the arm 315 and moved it to the blocking position of FIG. 10. Further pulling on the string 100 typically will result in breakage of the string 100 and/or separation of the string 100 from the end 323 of the banknote. FIG. 10 also illustrates how the latch arrangement 306 has pivoted and the spring bias 308 has extended.

It has been found that this arrangement provides a cost effective passive latch arrangement that is quite effective in stopping banknote being removed from the cashbox. It can also be seen that the partially withdrawn banknote 307 of FIG. 10 has been partially blocked from the drive rollers 320. With this arrangement recycling of the stacker light can effectively return this partially withdrawn banknote to the storage chamber. The bill might be slightly damaged however the device can continue to operate.

It is desirable with stand alone validators to provide a system where such phishing attempts are not successful. Once it has been generally found that such a phishing attempt will be defeated the number attempts at this type of fraudulent withdrawal significantly decreases. It has been found that this latch arrangement is quite effective in preventing the unauthorized withdrawal of a banknote by phishing.

Although preferred embodiments of the invention have been described herein in detail, it will be appreciated by those skilled in the art, that variations may be made thereto without departing from the invention as defined in the appended claims.

The embodiments of the invention in which an exclusive property or privilege is claimed are defined as follows:

1. A cashbox for use with a banknote validator comprising:

a generally closed box with a banknote inlet slot configured to allow banknotes to enter the cashbox;

a banknote stacker mechanism interior configured to displace a received banknote, that is received through the banknote inlet slot, to a banknote receiving channel, wherein the banknote stacker mechanism, when actuated, is configured to move from an initial position to one side of the banknote receiving channel through the banknote receiving channel, retaining a banknote in the banknote receiving channel and displacing the banknote into a banknote storage chamber; and a banknote latch arrangement including a pivoted blocking arm positioned adjacent to the banknote inlet slot and between the banknote inlet slot and the banknote storage chamber, wherein the pivoted blocking arm is configured to bias to a neutral position out of contact with a banknote being received in the banknote receiving channel and configured to move to a clear position at an end of the banknote stacker mechanism during displacement of the banknote into the banknote storage chamber, and wherein the pivoted blocking arm, upon return of the banknote stacker mechanism to the initial position, is configured to return to the neutral position, the pivoted blocking arm being positioned to be between banknotes stacked in the banknote storage chamber and the banknote inlet slot and configured to move against the bias by a previously stacked banknote to a blocking position closing the banknote inlet slot when an attempt is made to retrieve the previously stacked banknote through the banknote inlet slot.

2. The cashbox as claimed in claim 1, wherein the pivoted blocking arm is configured to rotate in a first direction against the bias during movement to the clear position and is configured to rotate in a second direction to the blocking position.

3. The cashbox as claimed in claim 2, wherein the pivoted blocking arm includes two projecting members that extend into recessed portions of a pusher plate of a stacking member allowing the pusher plate to move back and forth past the pivoted blocking arm when in the neutral position.

4. The cashbox as claimed in claim 3, wherein the pusher plate is positioned between the recesses portions and has a narrow gap with the banknote latch arrangement during movement of the pusher plate past the banknote latch arrangement.

5. The cashbox as claimed in claim 3, wherein each projecting member includes two projecting prongs with a gap therebetween that are configured to engage a structural member of the cashbox adjacent to the banknote inlet slot when the banknote latch arrangement is in the blocking position.

6. The cashbox as claimed in claim 1, further comprising a light channel adjacent to the banknote inlet slot and configured to transmit light therethrough if a banknote is not in the banknote inlet slot and configured to not transmit light if a banknote is present in the banknote inlet slot, the light channel configured to allow a determination of a full receipt of a banknote through the banknote inlet slot before activating the banknote stacker mechanism.

7. The cashbox as claimed in claim 6, wherein the light channel includes a first section extending up to and configured to transmit light across the banknote inlet slot at a first position, a second section configured to receive light transmitted from the first section if a banknote does not interrupt the transmitted light, wherein the second section configured to guide and retransmit the received light from the first section across the banknote inlet slot at a second position that cooperates with a third section for receiving light transmitted by second section across the banknote inlet slot if a banknote is not present.

8. The cashbox as claimed in claim 7, comprising a light receiving portion of the first section in a wall of the cashbox configured to receive light from a bill validator, and wherein the third section includes a light transmitting end in a wall of the cashbox configured to transmit any light transmitted therethrough to a bill validator.

9. The cashbox as claimed in claim 6, wherein the light channel is 'U' shaped.

10. The cashbox of claim 1, wherein the banknote latch arrangement is positioned to be displaced from the neutral position to the clear position during stacking of a banknote.

11. The cashbox as claimed in claim 4, wherein each projecting member includes two projecting prongs with a gap therebetween that are configured to engage a structural member of the cashbox adjacent to the banknote inlet slot when the banknote latch arrangement is in the blocking position.

12. The cashbox as claimed in claim 2, further comprising a light channel adjacent to the banknote inlet slot and configured to transmit light therethrough if a banknote is not in the banknote inlet slot and configured to not transmit light if a banknote is present in the banknote inlet slot, the light channel configured to allow a determination of a full receipt of a banknote through the banknote inlet slot before activating the banknote stacker mechanism.

13. The cashbox as claimed in claim 3, further comprising a light channel adjacent to the banknote inlet slot and configured to transmit light therethrough if a banknote is not in the banknote inlet slot and configured to not transmit light if a banknote is present in the banknote inlet slot, the light channel configured to allow a determination of a full receipt of a banknote through the banknote inlet slot before activating the banknote stacker banknote mechanism.

14. The cashbox as claimed in claim 4, further comprising a light channel adjacent to the banknote inlet slot and configured to transmit light therethrough if a banknote is not in the banknote inlet slot and configured to not transmit light if a banknote is present in the banknote inlet slot, the light channel configured to allow a determination of a full receipt of a banknote through the banknote inlet slot before activating the banknote stacker mechanism.

15. The cashbox as claimed in claim 2, wherein the banknote latch arrangement is positioned to be displaced from the neutral position to the clear position during stacking of a banknote.

16. The cashbox as claimed in claim 3, wherein the banknote latch arrangement is positioned to be displaced from the neutral position to the clear position during stacking of a banknote.

17. A method implemented using a cash box, the method comprising:

receiving, via an inlet slot of the cash box, a banknote;

moving, through a receiving channel of the cash box, the banknote from the inlet slot to a banknote storage chamber; and in response to the banknote storage chamber receiving the banknote, moving a blocking arm into a receiving channel obstructing position to at least partially obstruct the receiving channel, wherein the blocking arm includes two projecting members that extend into recessed portions of a pusher plate.

18. The method as claimed in claim 17, further comprising determining a full receipt of the banknote through the inlet slot using a light channel before moving the banknote from the inlet slot to the banknote storage chamber.

19. The method as claimed in claim 17, further comprising engaging projecting prongs of each of the projecting member with a structural member of a cashbox adjacent to the inlet slot when the blocking arm is in the receiving channel obstructing position.

* * * * *